US006793513B2

(12) United States Patent
Shibata

(10) Patent No.: US 6,793,513 B2
(45) Date of Patent: Sep. 21, 2004

(54) CONNECTOR WITH AN INERTIAL LOCKING FUNCTION

(75) Inventor: Takahiro Shibata, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/383,350

(22) Filed: Mar. 6, 2003

(65) Prior Publication Data

US 2004/0005805 A1 Jan. 8, 2004

(30) Foreign Application Priority Data

Jul. 3, 2002 (JP) ..... 2002-061951

(51) Int. Cl.[7] ..... H01R 13/52
(52) U.S. Cl. ..... 439/271
(58) Field of Search ..... 439/271, 358, 439/357, 272–275

(56) References Cited

U.S. PATENT DOCUMENTS 5,484,301 A 1/1996 Koumatsu et al.
6,186,814 B1 * 2/2001 Matsushita ..... 439/271
6,280,237 B1 * 8/2001 Saka et al. ..... 439/489
6,409,552 B2 * 6/2002 Matsumoto ..... 439/752
6,443,764 B2 * 9/2002 Makita ..... 439/587
6,558,178 B2 * 5/2003 Nakamura ..... 439/271

* cited by examiner

*Primary Examiner*—Gary Paumen
(74) *Attorney, Agent, or Firm*—Gerald E. Hespos; Anthony J. Casella

(57) ABSTRACT

A connection resistance (Ra) caused by a seal (50) reaches a maximum at earlier than a resistance force of an inertial locking means acts. Thus, a total connection resistance (R) created during a connecting operation (10, 20) after the cancellation of inertial locking is reduced by the connection resistance (Ra) caused by the seal (50). Thus, a difference between the operation force (F) required to cancel the resistance of resistance arms (34) and the total connection resistance (F) created after the cancellation of this resistance becomes larger, thereby improving the reliability of an inertial locking function of continuing the connecting operation at a stroke.

12 Claims, 10 Drawing Sheets

CONNECTOR WITH AN INERTIAL LOCKING FUNCTION

BACKGROUND OF THE INVENTION

1. Field of the Invention

The invention relates to a connector with an inertial locking function.

2. Description of the Related Art

A connector has housings and terminal fittings are mounted in the housings. The housings can be connected to electrically connect the terminal fittings. A resilient contact on one terminal fitting is brought resiliently into contact with the mating terminal fitting to ensure contact reliability between the two terminal fittings. Thus, a frictional resistance is created when the housings are connected due to the resilient contact between the terminal fittings and acts as a connection resistance against the connection of the housings. A connection resistance due to the resilient deformation of a lock arm for locking the housings in their properly connected state also is created in the connecting process. A watertight connector also exhibits a connection resistance due to frictional resistance between a rubber seal ring mounted between the housings. Thus, a large connection resistance is unavoidable in the connecting process and is a sum of the above connection resistances.

Increased connection resistance due to the terminal fittings, the lock arm and the seal ring at an intermediate stage of the connecting operation may be interpreted incorrectly as complete insertion, and an operator may end the connecting operation in response to such increased connection resistance.

An "inertial locking construction" is adopted widely to prevent incomplete connection. This construction has a resistance arm in one housing that abuts the other housing before the connection resistance is created. Thus, a resistance force larger than the connection resistance is created intentionally. An operation force that exceeds the intentional resistance force by the resistance arm must be created. This operation force also is larger than the connection resistance is given. The abutment of the resistance arm is canceled during the connection process. The connecting operation of the housings then proceeds at a stroke by a force given to cancel the intentional resistance. As a result, the two housings reach a properly connected state.

The connecting operation will proceed at a stroke after cancellation of the intentional resistance if there is a large difference between the operation force required to cancel the intentional resistance and a sum of the connection resistances by the terminal fittings, the lock arm, the seal ring after the cancellation of the resistance. The connection resistances may be set smaller and/or the resistance canceling force may be set larger to maximize this difference. However, smaller connection resistances cause a reduction in the contact reliability between the terminal fittings, a reduction in the reliability of a locking function by the lock arm and a reduction in the reliability of a sealing function by the seal ring. On the other hand, a larger resistance canceling force results in an increased burden on the operator. Thus, it has been difficult to improve the reliability of an inertial locking function by enlarging the difference between the resistance canceling force and the connection resistances.

The present invention was developed in view of the above problems and an object thereof is to improve the reliability of an inertial locking function.

SUMMARY OF THE INVENTION

The invention relates to a connector with first and second housings that are connectable with each other. Terminal fittings are mounted in the housings and connect with each other in the process of connecting the housings. The connection of the terminal fittings creates a frictional resistance. The first housing has a resistance arm and the second housing has an abutment, which together form an inertial locking means. The resistance arm contacts the abutment during a connecting operation and creates a resistance force. A resistance canceling force that exceeds the resistance force can be given to the housings to deform the resistance arm away from the abutment and to cancel the resistance. The connecting operation of the housings proceeds at a stroke after the cancellation of the resistance.

A tubular seal is mounted on a peripheral surface of one housing and resiliently contacts a peripheral surface of the mating housing in the process of connecting the housings. The seal and the peripheral surface of the mating housing preferably contact in the process of connecting the housings and a connection resistance created by the resilient deformation of the seal reaches a maximum before the resistance arm and the abutment abut.

A maximum value of the connection resistance due to resilient deformation of the seal preferably is less than the resistance canceling force.

The connection resistance caused by the ring reaches a maximum before the resistance of the inertial locking means is created. Thus, the maximum connection resistance created in the process of continuing the connecting operation in a single stroke after the cancellation of the resistance by the inertial locking means is smaller by the magnitude of the connection resistance caused by the seal ring. Therefore, a difference between the operation force required to cancel the resistance of the resistance arm and the connection resistance created after the cancellation of the resistance becomes larger. Accordingly, the connection is more likely to proceed in a single stroke.

The resilient restoring forces of the seal between the peripheral surfaces of the housings concentrically position the housings relative to one another at an early stage of the connecting process. Thus the resistance arm will not displace transversely relative to the abutment, and the reliability of the inertial locking function is assured.

A resilient contact rib is formed near the front end of the seal and assures a sealing engagement with both the housing and the mating housing. This sealing engagement defines a loose-movement preventing means for preventing loose backward movements of the front end of the seal.

The resilient contact near the front of the seal creates a connection resistance before the resistance arm and the abutment engage. However, the loose movement preventing means assures that the frictional resistance between the seal and the mating housing will not push the front end of the seal back. Therefore, even a long seal will not buckle.

The seal is squeezed between an inner peripheral surface of a receptacle of the mating housing and a fittable portion of the housing fit into the receptacle.

These and other features of the invention will become more apparent upon reading of the following detailed description and accompanying drawings. It should be understood that even though embodiments are described separately, single features may be combined to additional embodiments.

DETAILED DESCRIPTION OF THE PREFERRED EMBODIMENTS

Figure 1:
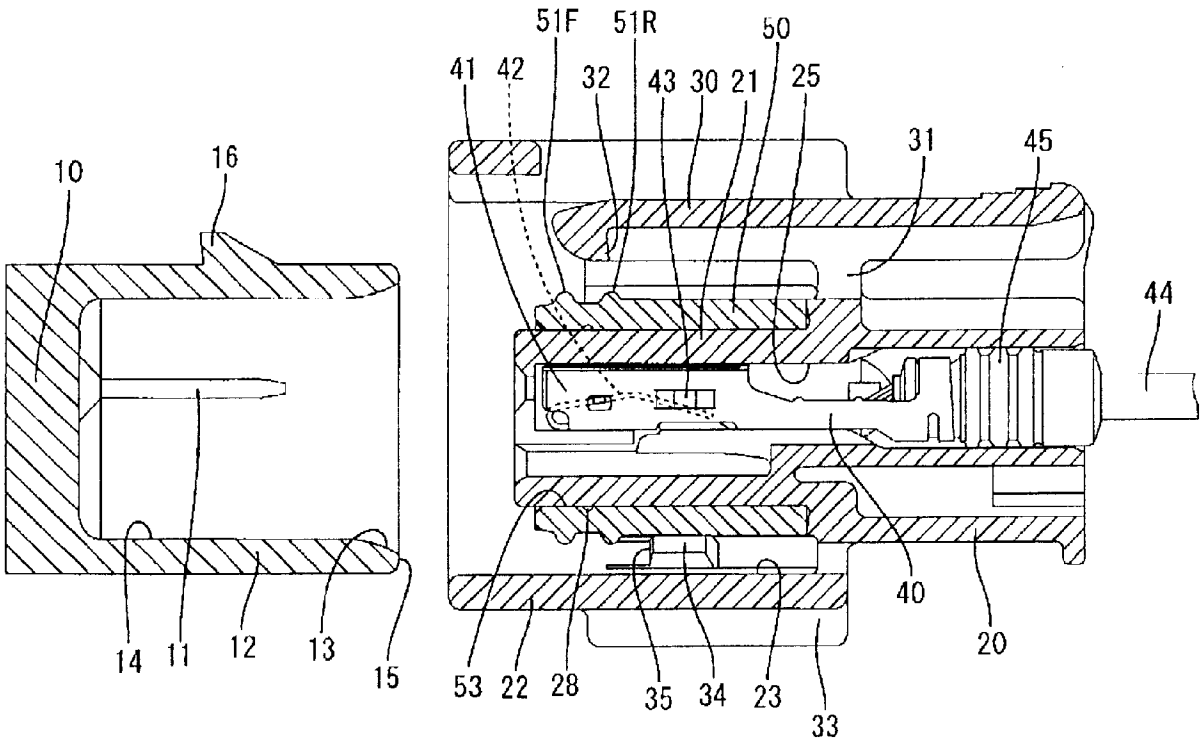
FIG. 1 is a vertical section showing a separated state of a male housing and a female housing according to one embodiment of the invention.

Hereinafter, one preferred embodiment of the present invention is described with reference to FIGS. 1 to 10.

A watertight connector according to the invention is illustrated in FIGS. 1 to 10 and comprises a male housing 10 and a female housing 20 that are connectable with each other. The male housing 10 is made e.g. of a synthetic resin and tabs at the leading ends of male terminal fittings 11 project forward in the male housing 10. A rectangular tubular receptacle 12 projects forward to surround and protect the tabs. An outwardly slanted guide surface 13 is formed around the open front end of the inner peripheral surface of the receptacle 12 and a sealing surface 14 is defined along the inner peripheral surface of the receptacle 12 rearward of the guide surface 13. The sealing surface 14 extends substantially parallel to forward and backward directions. An abutment 15 is defined at the front edge of the receptacle 12 and a lock 16 projects on the outer upper surface of the upper wall of the receptacle 12.

The female housing 20 is made e.g. of a synthetic resin and a fittable portion 21 at the front of the female housing 20 is dimensioned to fit into the receptacle 12. The female housing 20 also has a forwardly projecting tube 22 that surrounds the fittable portion 21. The receptacle 12 can be fit into a tubular space 23 between the outer peripheral surface of the fittable portion 21 and the inner peripheral surface of the tube 22. A holding space 24 is recessed in a left-side area at the back end of the tubular space 23 and opens to the outer surface of the female housing 20.

Left and right cavities 25 are formed in the female housing 20, and an escaping groove 26 extends forward and backward in the left inner wall surface of each cavity 25. An outwardly projecting rib 27 extends forward and backward on the left side surface of the fittable portion 21 and aligns with the escaping groove 26. The front end of the rib 27 is slightly behind the front end of the fittable portion 21, and a smooth sealing surface 28 is defined around the outer periphery of the fittable portion 21 before the front end of the rib 27. The front end of the rib 27 forms a step 29 with respect to the rear end of the sealing surface 28.

A lock arm 30 projects forward and back from a support 31 at the upper surface of the female housing 20 substantially at the rear end of the fittable portion 21. Thus, the lock arm 30 is resiliently pivotable about the support 31 like a seesaw. A locking claw 32 is formed at the front end of the lock arm 30 and is engageable with the lock 16 of the male housing 10.

Bulging portions 33 bulge obliquely out and down from the left and right ends of the bottom wall of the tubular portion 22, and inner spaces of the bulging portions 33 communicate with the tubular space 23. A resistance arm 34 cantilevers backward in the inner space of each bulging portion 33. An abutting surface 35 is formed at the rear end of each resistance arm 34 and is substantially normal to connecting directions of the two housings 10, 20.

A box 41 is formed at the front of each female terminal fitting 40 and a resilient contact 42 is formed inside the box 41 for contacting the tab of the corresponding male terminal fitting 11 with a specified contact pressure. An improper or upside-down insertion preventing projection 43 is formed on the left side of the box 41 to preventing the female terminal fitting 40 from being inserted into the cavity 25 at an improper rotational orientation. A wire 44 and a rubber plug 45 are crimped into engagement with the rear end of the female terminal fitting 40. The female terminal fittings 40 are inserted respectively into the cavities 25 from behind, and the rubber plug 45 seals a clearance between the female terminal fitting 40 and the inner surface of the cavity 25.

A tubular seal 50 made of a resilient material, such as a rubber, is mounted on the outer peripheral surface of the fittable portion 21. Two resilient contacts 51F, 51R in the form of ribs extend around the entire outer periphery of the seal 50 near the front end of the seal 50. Long narrow recesses 52 extend forward and back along the inner surfaces of the left and right sidewalls of the seal 50 and reach the rear edge of the seal 50. A smooth sealing surface 53 is formed continuously around the inner peripheral surface of the front end of the seal 50 before the recesses 52, and steps 54 are formed at the front ends of the recesses 52 behind the sealing surface 53. A lock 55 extends back at the rear end of each of the left and right walls of the seal ring 50, and a locking piece 56 projects out at the rear end of each lock 55.

The seal 50 is mounted on the outer peripheral surface of the fittable portion 21 from the front. Thus, the left recess 52 engages the rib 27, and the steps 29, 54 are brought into contact. The contact of the steps 29, 54 prevents the seal 50 from making loose backward movements with respect to the fittable portion 21. Further, the sealing surfaces 28, 53 of the fittable portion 21 and the seal 50 are held in close contact with each other over their entire peripheries. The locks 55 at the rear end of the seal 50 are inserted in the holding space 24. A stopper 57 then is fit into the holding space 24 and engages the corresponding locking piece 56 to prevent the seal 50 from making loose forward movements with respect to the fittable portion 21.

Figure 10:
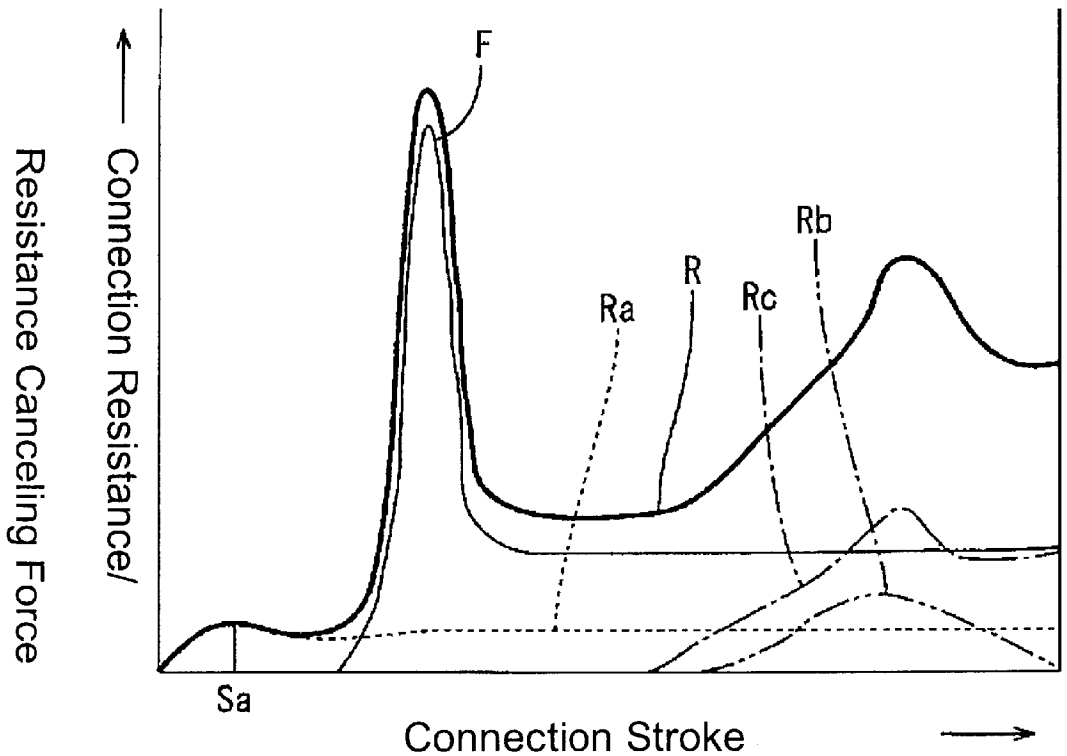
FIG. 10 is a graph showing a variation of a resistance canceling force of an inertial locking means and variations of the respective connection resistances in the process of connecting the two housings.

The horizontal axis of the graph in FIG. 10 represents a connection stroke from the start of connection of the two housings 10, 20 to the end of connection where the properly connected state is reached. The vertical axis represents connection resistances and a resistance canceling force of the inertial locking means.

Figure 2:
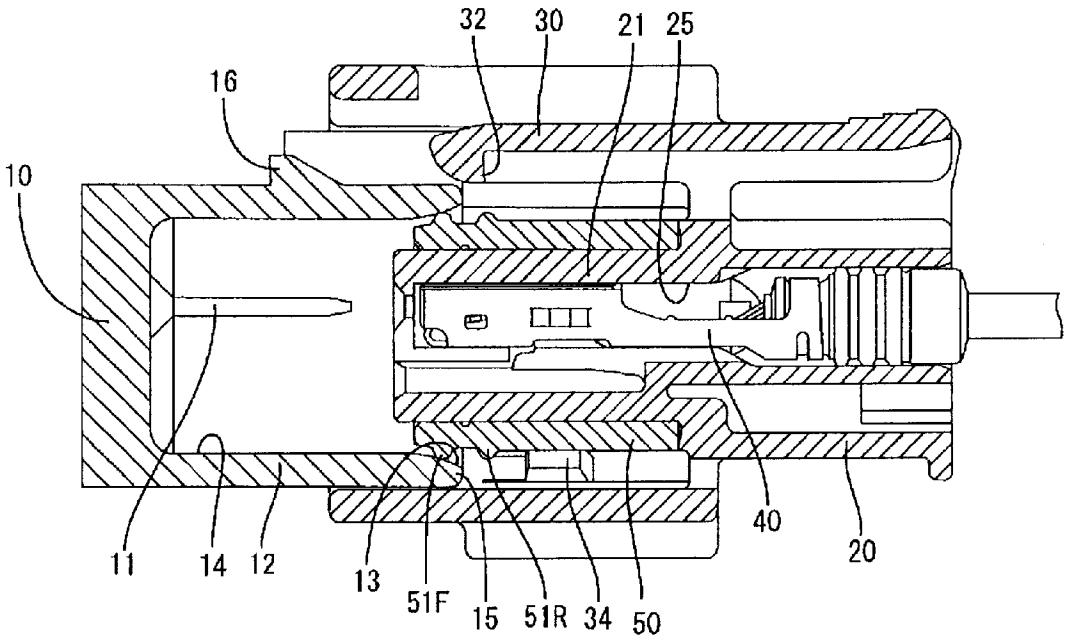
FIG. 2 is a vertical section showing a state immediately after a connection resistance caused by a seal is created.
Figure 3:
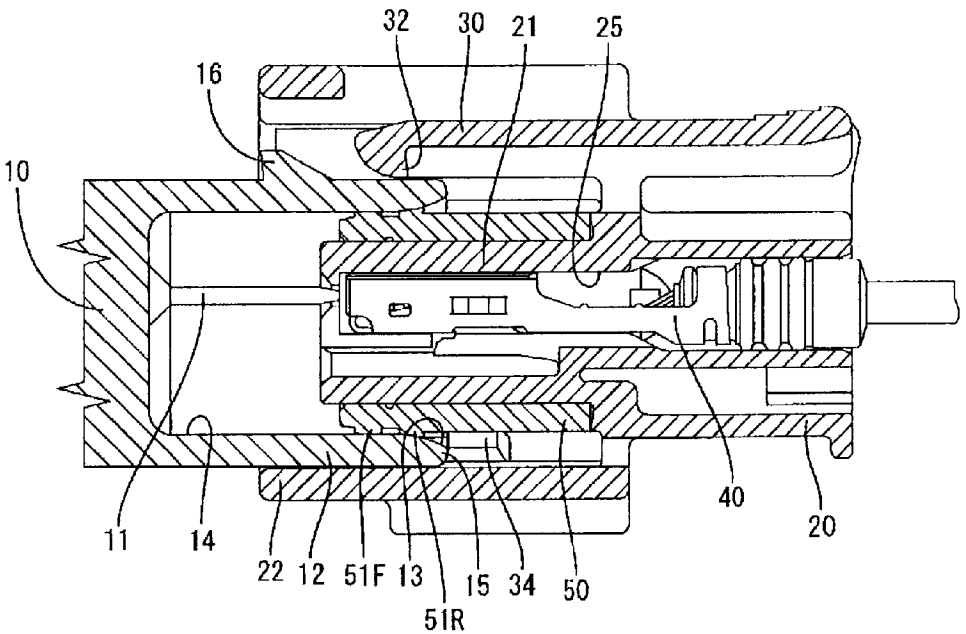
FIG. 3 is a vertical section showing a state where the two housings are connected until resistance arms and an abutment abut.

The guide surface 13 of the receptacle 12 contacts the resilient contact 51F of the seal 50 in the process of connecting the two housings 10, 20. Thus, the resilient contact 51F is deformed resiliently and squeezed between the guide surface 13 and the fittable portion 21, as shown in FIG. 2. Consequently, a frictional resistance is created between the seal 50 and the receptacle 12 due to the resilient restoring force of the seal 50 and becomes a connection resistance Ra (see the graph of FIG. 10) against the connecting operation of the two housings 10, 20. The connection resistance Ra caused by the seal 50 reaches a maximum when the deformation of the resilient contact 51F is started (Sa in the graph of FIG. 10) and, thereafter, takes a substantially constant value until the two housings 10, 20 are connected properly.

Figure 4:
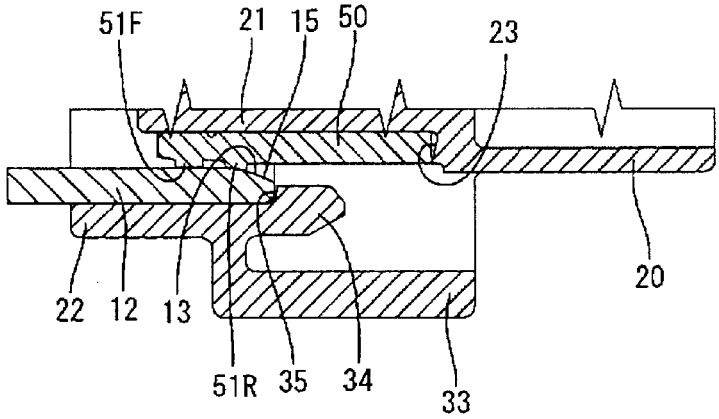
FIG. 4 is a partial section showing a state where the resistance arms and the abutment abut.

The abutting surfaces 35 of the resistance arms 34 then engage the abutment 15 at the front edge of the receptacle 12, as shown in FIG. 4, and a resistance force against the connecting operation of the two housings 10, 20 is created by this abutment. The abutting surfaces 35 of the resistance arms 34 are substantially normal to the connecting direction. Thus, an operation force F acting in the connecting direction and necessary to deform the resistance arms 34 outward and from the abutment 15 must exceed the resilient forces of the resistance arms 34 and is considerably large. The extent of this resistance canceling force is set at a value larger than a maximum value of a total connection resistance R. In this regard, the total connection resistance R is the sum of a connection resistance Rc caused by the terminal fittings 11, 30, a connection resistance Rb caused by the lock arm 30, and the connection resistance Ra caused by the seal 50 after the resistance caused by the resistance arms 34 is canceled. Further, a maximum value of the connection resistance Ra caused by the seal ring 50 is smaller than this resistance canceling force F.

The resistance arms 34 deform resiliently and disengage from the abutment 15 when the specified resistance canceling force F is given to the housings 10, 20 in the state shown in FIG. 4. As a result, the resistance caused by the resistance arms 34 is alleviated suddenly. The connection resistance Ra caused by the seal ring 50 is substantially the only remaining connection resistance immediately after the resistance caused by the resistance arms 34 is alleviated. Thus, the value of the total connection resistance R against the connecting operation of the housings 10, 20 becomes suddenly smaller. This sudden decrease in the total connection resistance R enables the resistance canceling force F to drive the connecting operation in a single stroke and the two housings 10, 20 reach the properly connected state in this single stroke.

Figure 5:
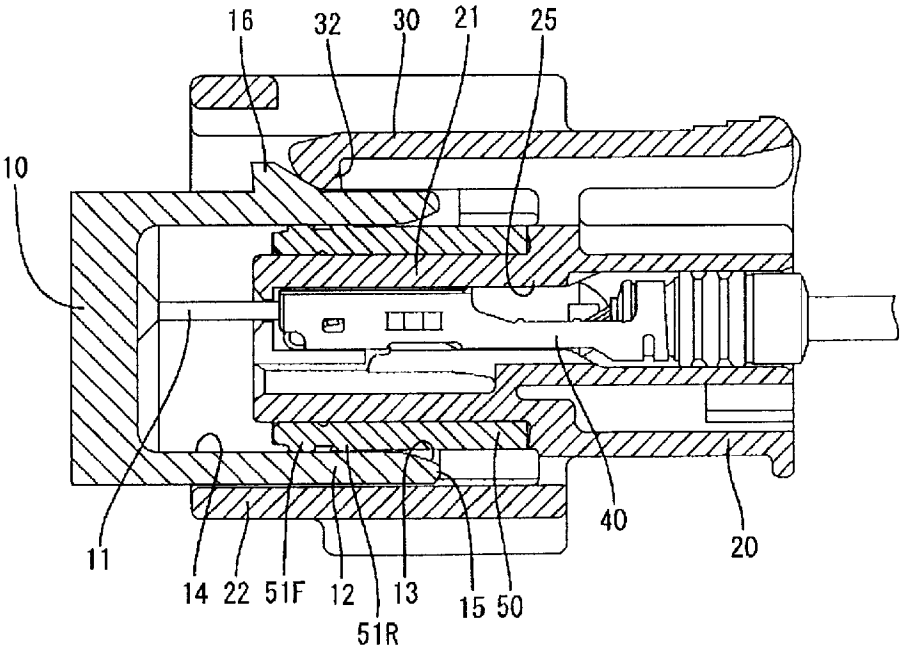
FIG. 5 is a vertical section showing a state immediately after a connection resistance caused by a lock arm is created.

The locking claw 32 of the lock arm 30 contacts the lock 16 of the receptacle 12, as shown in FIG. 5, after the cancellation of the resistance caused by the resistance arms 34 and before the housings 10, 20 are connected properly. Thereafter, the lock arm 30 resiliently deforms and moves over the lock 16. The connection resistance Rb (see the graph of FIG. 10) caused by the resilient restoring force of the lock arm 30 is created as the lock arm 30 moves over the lock 16. The connection resistance Rb caused by the lock arm 30 is substantially proportional to the degree of resilient deformation of the lock arm 30 and varies along a substantially convex curve.

Figure 6:
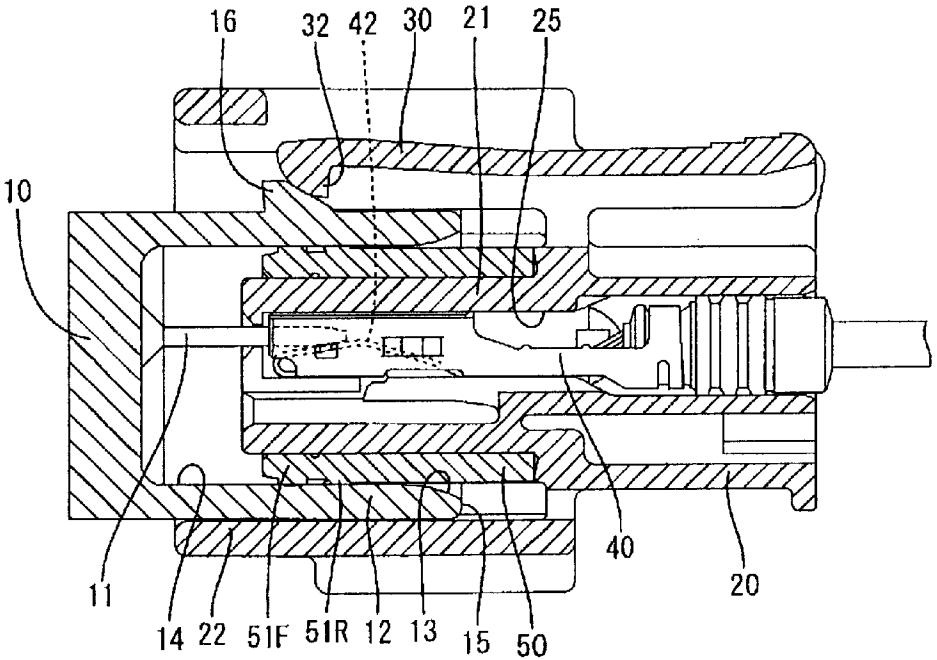
FIG. 6 is a vertical section showing a state immediately after a connection resistance caused by terminal fittings is created.
Figure 7:
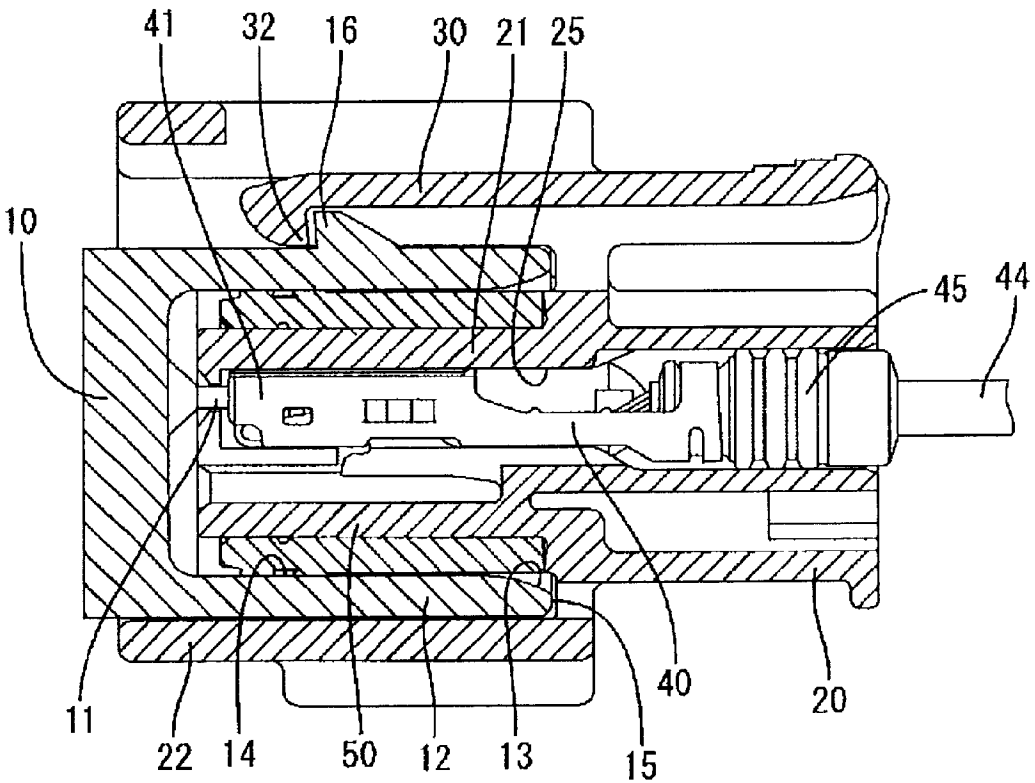
FIG. 7 is a vertical section showing a state where the two housings are properly connected.
Figure 8:
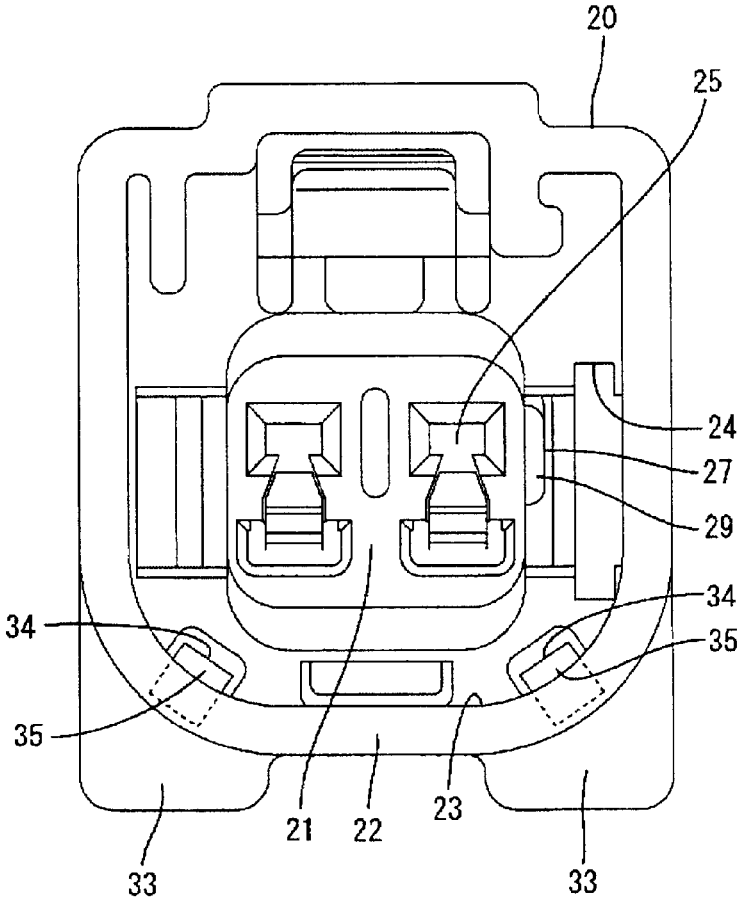
FIG. 8 is a front view of the female housing.
Figure 9:
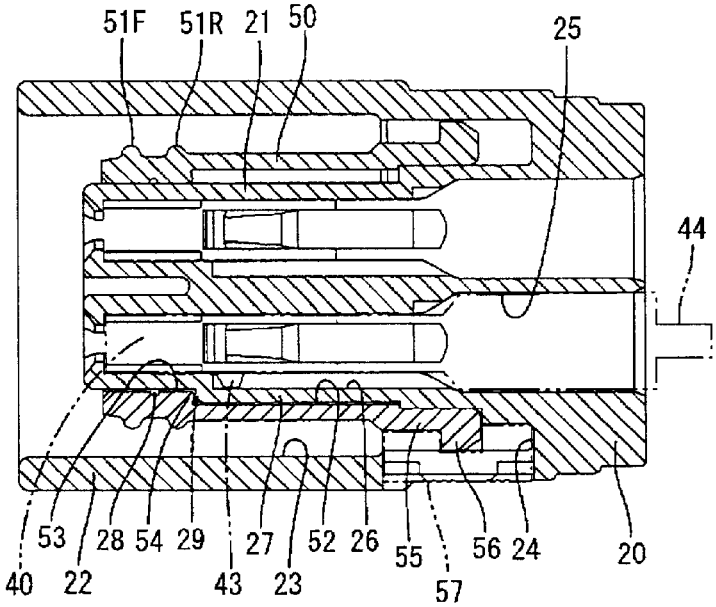
FIG. 9 is a horizontal section of the female housing.

The tabs of the male terminal fittings 11 that project into the female housing 20 contact the resilient contact pieces 42 of the female terminal fittings 40 immediately before the connection resistance Rb caused by the lock arm 30 is created. Thus, the resilient contact pieces 42 resiliently deform, as shown in FIG. 6. The connection resistance Rc (see the graph of FIG. 10) caused by the resilient restoring forces of the resilient contact pieces 42 is created as the tabs are brought resiliently into contact. The connection resistance Rc acting between the terminal fittings 11, 40 is substantially proportional to the degree of resilient deformation of the resilient contact pieces 42 and is at its maximum immediately after the connection resistance Rb caused by the lock arm 30 reaches its maximum. The connection resistance Rc decreases as the connecting operation of the two housings 10, 20 proceeds and takes a substantially constant value thereafter.

The maximum value of the total connection resistance R (see the graph of FIG. 10) is a sum of the connection resistance Rb caused by the lock arm 30, the connection resistance Rc caused by the terminal fittings 11, 30 and the connection resistance Ra caused by the seal ring 50. This total connection resistance R is smaller than the resistance canceling force F. Thus, the connecting operation of the two housings 10, 20 proceeds smoothly and in a single stroke merely by applying the resistance canceling force F.

As described above, the connection resistance Ra caused by the seal 50 occurs before and reaches a maximum before the resistance force of the inertial locking means is given. Accordingly, the maximum value of the total connection resistance R that acts in the process of continuing the connecting operation of the two housings 10, 20 is smaller due to the shifting in the connection stroke of the maximum-value of the connection resistance Ra caused by the seal 50. Thus, a difference between the operation force F required to cancel the resistance caused by the resistance arms 34 and the total connection resistance R created after the resistance is canceled becomes larger, and the reliability of the inertial locking means continuing the connecting operation at a stroke is improved.

The seal 50 is squeezed radially between the inner peripheral surface of the receptacle 12 of the male housing 10 and the outer peripheral surface of the fittable portion 21 of the female housing 20. Thus, the resilient restoring force of the seal 50 concentrically positions the two housings 10, 20 with respect to each other at an earlier stage of the connecting operation. This prevents relative radial displacements of the resistance arms 34 and the abutment 15, and the reliability of the inertial locking function is secured.

The resilient contacts 51F, 51R that resiliently contact the male housing 10 are near the front of the seal 50. Thus, the connection resistance Ra by the seal 50 is created before the resistance arms 34 engage the abutment 15. The seal 50 has the locks 55 at its rear end fastened and is long along forward and backward directions. Additionally, the seal 50 may have the resilient contacts 51F, 51R near the front pushed back by the frictional resistance between the seal 50 and the receptacle 12 during the connecting operation. However, the engagement of the steps 29, 54 on the outer peripheral surface of the fittable portion 21 and on the inner peripheral surface of the seal 50 (see FIG. 9) prevents loose backward movements of the resilient contacts 51F, 51R. Therefore, the seal 50 will not buckle even if the receptacle 12 pushes the resilient contacts 51F, 51R backward.

The invention is not limited to the above described and illustrated embodiment. For example, the following embodiments are also embraced by the technical scope of the present invention as defined in the claims. Beside the following embodiments, various changes can be made without departing from the scope and spirit of the present invention as defined in the claims.

The resistance arms and the lock arm are provided separately in the foregoing embodiment. However, the resistance arms may also serve as the lock arm according to the present invention.

The receptacle of the male housing also serves as the abutment in the foregoing embodiment. However, an abutment separate from the receptacle may be provided according to the present invention.

The resistance arms are provided in the female housing in the foregoing embodiment. However, they may be provided in the male housing according to the present invention.

Although the seal ring is mounted along the outer peripheral surface of the fittable portion in the foregoing embodiment, it may be mounted along the inner peripheral surface of the tube according to the present invention.

Although the seal ring is provided in the female housing in the foregoing embodiment, it may be provided in the male housing according to the present invention.

Although the resistance arms are resiliently deformable in radial direction in the foregoing embodiment, they may be resiliently deformable in circumferential direction according to the present invention.

What is claimed is:

1. A connector, comprising:

first and second housings connectable with each other;

at least first and second terminal fittings mounted respectively in the first and second housings and connectable with each other with frictional resistance while connecting the housings;

an inertial locking means including at least one abutment on the first housing and at least one resistance arm on the second housing, the resistance arm being configured for contacting the abutment during connection of the housings and creating a resistance force against a connecting operation of the housings, the resistance arm further being configured to deform resiliently in a direction for disengaging the resistance arm from the abutment in response to a resistance canceling force at a selected stage during the connection of the housings, thereby canceling the resistance force so that the connection of the housings proceeds efficiently; and a seal mounted along a peripheral surface of the second housing for resilient contact with a peripheral surface of the first housing during connection, wherein the seal and the peripheral surface of the first housing contact during connection of the housings and a connection resistance created by resilient deformation of the seal reaches a maximum value before the resistance arm contacts the abutment.

2. The connector of claim 1, wherein a maximum value of the connection resistance created by the resilient deformation of the seal is smaller than the resistance canceling force.

3. The connector of claim 1, wherein the seal has a rear end held on the second housing to prevent disengagement.

4. The connector of claim 1, further comprising at least one resilient contact at a front end of the seal for creating a connection resistance between the seal and the first housing.

5. The connector of claim 4, wherein at least one of the seal and the second housing comprise loose-movement preventing means for preventing loose backward movement of the resilient contact.

6. The connector of claim 1, wherein the seal is squeezed between an inner peripheral surface of the first housing and a fittable portion of the second housing.

7. A connector, comprising:

first and second housings connectable with each other;

at least one abutment on the first housing and at least one resistance arm on the second housing, the resistance arm being configured for contacting the abutment during connection of the housings and creating a resistance force against connection of the housings, the resistance arm further being configured to deform resiliently and disengage from the abutment in response to a resistance canceling force at a selected stage during the connection of the housings, thereby canceling the resistance force; and a seal mounted along an outer peripheral surface of the second housing, at least one resilient contact at a front end of the seal for contacting an inner peripheral surface of the first housing during connection and creating a connection resistance between the seal and the first housing, the connection resistance between the seal and the first housing reaching a maximum before the resistance arm contacts the abutment.

8. The connector of claim 7, wherein a maximum value of the connection resistance created by the seal is smaller than the resistance canceling force.

9. The connector of claim 8, further comprising first and second terminal fittings mounted respectively in the first and second housings and connectable with each other with frictional resistance that occurs after the resistance arm disengages from the abutment, the frictional resistance being less than the resistance canceling force.

10. The connector of claim 9, further comprising a lock arm on the second housing for engaging a lock on the first housing with a locking resistance that occurs after the resistance arm disengages from the abutment, the locking resistance being less than the resistance canceling force.

11. The connector of claim 10, wherein a sum of the frictional resistance and the locking resistance is less than the resistance canceling force.

12. The connector of claim 10, wherein a sum of the connection resistance, the locking resistance and the frictional resistance at any time during connection is less than the resistance canceling force.

* * * * *